US007075238B2

(12) United States Patent
Lee et al.

(10) Patent No.: US 7,075,238 B2
(45) Date of Patent: Jul. 11, 2006

(54) ORGANIC LIGHT EMITTING DISPLAY AND DISPLAY UNIT THEREOF

(75) Inventors: Kuo-Sheng Lee, Yongkang (TW); Shuo-Hsiu Hu, Tainan (TW)

(73) Assignee: Au Optronics Corp., Hsinchu (TW)

( * ) Notice: Subject to any disclaimer, the term of this patent is extended or adjusted under 35 U.S.C. 154(b) by 0 days.

(21) Appl. No.: 11/061,571

(22) Filed: Feb. 22, 2005

(65) Prior Publication Data

US 2006/0044235 A1 Mar. 2, 2006

(30) Foreign Application Priority Data

Sep. 1, 2004 (TW) ..... 93126437 A

(51) Int. Cl.
*G09G 3/10* (2006.01)

(52) U.S. Cl. ..... 315/169.1; 315/169.3; 345/76; 345/204

(58) Field of Classification Search ..... 315/169.3; 345/76

See application file for complete search history.

(56) References Cited

U.S. PATENT DOCUMENTS 6,989,826 B1 * 1/2006 Kasai ..... 345/204
6,998,790 B1 * 2/2006 Sun ..... 315/169.3

* cited by examiner

*Primary Examiner*—David Vu
(74) *Attorney, Agent, or Firm*—Rabin & Berdo P.C.

(57) ABSTRACT

An organic light emitting display includes a display unit, a scan line, a data line, a reference line and a main voltage line. The display unit includes a first PMOS transistor, an OLED and a capacitor. The first PMOS transistor generates a driving current. The OLED emits light according to the driving current. The capacitor has a first end and a second end, and the first end and the second end selectively and respectively receives a data signal and a reference voltage according to a control signal. The scan line is for transmitting a scan signal. The data line is for transmitting the data signal. The reference line is for outputting the reference voltage. The main voltage line is for outputting a main voltage to the first PMOS transistor.

16 Claims, 3 Drawing Sheets

ORGANIC LIGHT EMITTING DISPLAY AND DISPLAY UNIT THEREOF

This application claims the benefit of Taiwan application Serial No. 93126437, filed Sep. 1, 2004, the subject matter of which is incorporated herein by reference.

BACKGROUND OF THE INVENTION

1. Field of the Invention

The invention relates in general to an organic light emitting display, and more particularly to an organic light emitting display and a display unit thereof.

2. Description of the Related Art

FIG. 1 is a circuit diagram showing a conventional organic light emitting display unit. Referring to FIG. 1, the organic light emitting display unit 100 includes a NMOS transistor T1, a PMOS transistor T2, a capacitor C1 and an OLED (Organic Light Emitting Diode) O1. The NMOS transistor T1 has a drain for receiving a data signal Data and a gate for receiving a scan signal Scan. The capacitor C1 has a first end coupled to a source of the NMOS transistor T1, and a second end for receiving a main voltage Vdd. The PMOS transistor T2 has a source coupled to the second end of the capacitor C1, a gate coupled to the first end of the capacitor C1, and a drain coupled to a positive end of the OLED O1. A negative end of the OLED O1 is biased at a low main voltage Vss.

The luminance of the light emitted from the organic light emitting display unit 100 is mainly determined by the driving current I flowing through the OLED O1. The driving current I is generated by the PMOS transistor T2, and the driving current I corresponds to the difference Vgs between the gate voltage and the source voltage of the PMOS transistor T2. The source voltage of the PMOS transistor T2 is the main voltage Vdd, and the gate voltage of the PMOS transistor T2 is the data signal Data when the NMOS transistor T1 is turned on.

FIG. 2 is a schematic illustration showing a conventional organic light emitting display. Referring to FIG. 2, the organic light emitting display 200 includes display units 100(1,1) to 100(*m*,*n*), scan lines SL(1) to SL(m), data lines DL(1) to DL(n), and main voltage lines VL(1) to VL(n). The scan lines SL(1) to SL(m) are for respectively transmitting scan signals Scan(1) to Scan(m) to the gates of the NMOS transistors T1 in the corresponding display units 100. The data lines DL(1) to DL(n) are for respectively transmitting data signals Data(1) to Data(n) to the drains of the NMOS transistors T1 in the corresponding display units 100. The main voltage lines VL(1) to VL(n) are for outputting the main voltage Vdd to the second end of the capacitor C1 in the display unit 100. The main voltage Vdd is substantially constant. In practice, however, the impedances of the main voltage lines VL(1) to VL(n) cause voltage drops to the main voltage Vdd. Taking the A and B points in FIG. 2 as an example, A and B points are supplied with substantially the same main voltage Vdd by the main voltage line VL(2). However, because of the current and the impedance the main voltage line VL(2), the main voltage Vdd at B point is lower than the main voltage Vdd at A point due to the voltage drop. That is, the display units 100 at different positions actually receive the main voltages Vdd with different levels. Thus, the uneven luminance of the display unit 100 and the difference from the expected luminance are caused.

In addition, the voltage drop of the main voltage line further causes another problem, the loading effect. FIG. 3 is a schematic illustration showing a conventional organic light emitting display, which displays a full white frame and a frame with an upper half of a black section and a lower half of a white section. The organic light emitting display 200(1) is for displaying a full white frame in a white region D. The organic light emitting display 200(2) is for displaying a frame with an upper half of block section and a lower half of a white section in a black region E and a white region F, respectively. It is assumed that the required current on the main voltage line VL has to be I when the conventional organic light emitting display 200(1) displays the white region D. The required current on the main voltage line VL only has to be 0.5 I when the conventional organic light emitting display 200(2) displays the black region E and the white region F because only the voltage for the display unit of the white region F has to be provided. Ideally, the luminance of the white region D should be the same as that of the white region F. However, because the required current for the white region D is larger, the caused voltage drop of the main voltage Vdd is larger and the luminance of the white region D is inversely smaller. Oppositely, the white region F requires a smaller current and the voltage drop of the main voltage Vdd of the white region F is smaller such that the luminance of the white region F is closer to the ideal state and greater than that of the white region D. The loading effect disables the frame, which is displayed by the organic light emitting display, from reaching the predetermined luminance, but rather makes the luminance of the white region F in the frame, which has the upper half of a black section and the lower half of white section, greater than that of the white region D of the full white frame such that the display effect is not ideal.

When the organic light emitting display is applied to different electrical products, which may provide different main voltages Vdd, an extra regulation circuit is needed, or an external circuit has to be added to regulate the voltage in order to achieve the required pixel luminance. This approach, however, is uneconomic and the cost thereof is high.

SUMMARY OF THE INVENTION

It is therefore an object of the invention to provide an organic light emitting display having a display unit, which is free from being influenced by a drop of a main voltage, free from emitting uneven light luminance, and also free from being added an extra circuit owing to the limitation of the main voltage.

The invention achieves the above-identified object by providing an organic light emitting display, which includes a display unit, a scan line, a data line, a reference line and a main voltage line. The display unit includes a capacitor, a first PMOS transistor and an OLED. The capacitor has a first end and a second end, which selectively and respectively receive a data signal and a reference voltage according to a scan signal. The first PMOS transistor has a gate coupled to the first end of the capacitor. The OLED is coupled to the first PMOS transistor. When the scan signal is enabled, the first end and the second end of capacitor respectively receive the data signal and the reference voltage. When the scan signal is disabled, the source of the first PMOS transistor is biased at a main voltage and coupled to the second end of the capacitor such that a voltage difference between the source and gate of the first PMOS transistor substantially equals a crossover voltage of the capacitor. The first PMOS transistor outputs a driving current, which corresponds to a difference between the data signal and the reference voltage, to the OLED. The scan line transmits the scan signal. The data line transmits the data signal. The reference line outputs the reference voltage. The main voltage line outputs the main voltage.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
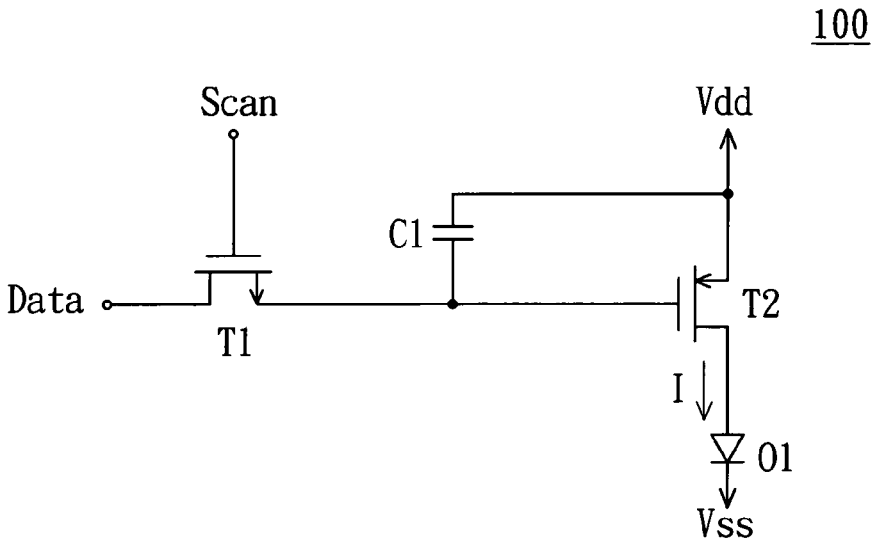
FIG. 1(PRIOR ART)
FIG. 1 is a circuit diagram showing a conventional organic light emitting display unit.
Figure 2:
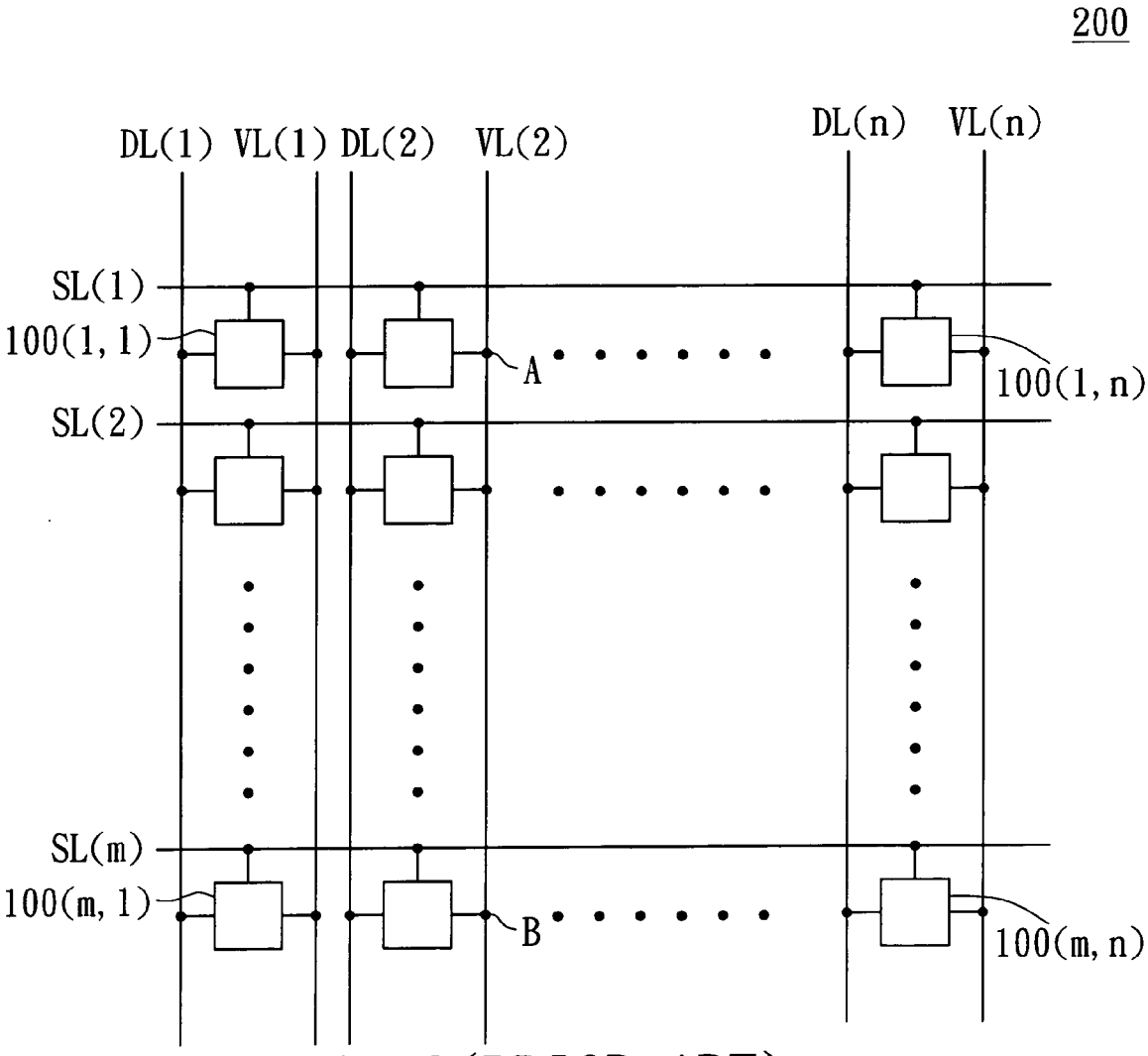
FIG. 2(PRIOR ART)
FIG. 2 is a schematic illustration showing a conventional organic light emitting display.
Figure 3:
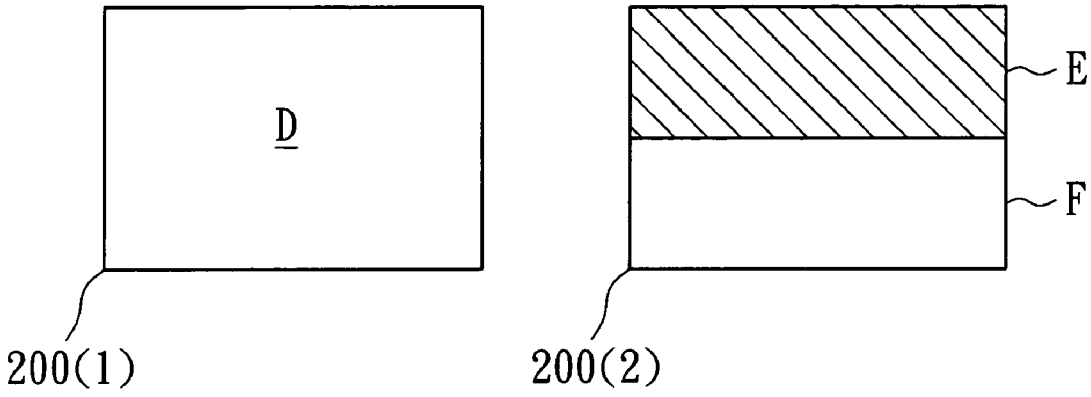
FIG. 3(PRIOR ART)
FIG. 3 is a schematic illustration showing a conventional organic light emitting display, which displays a full white frame and a frame with an upper half of a black section and a lower half of a white section.
Figure 4:
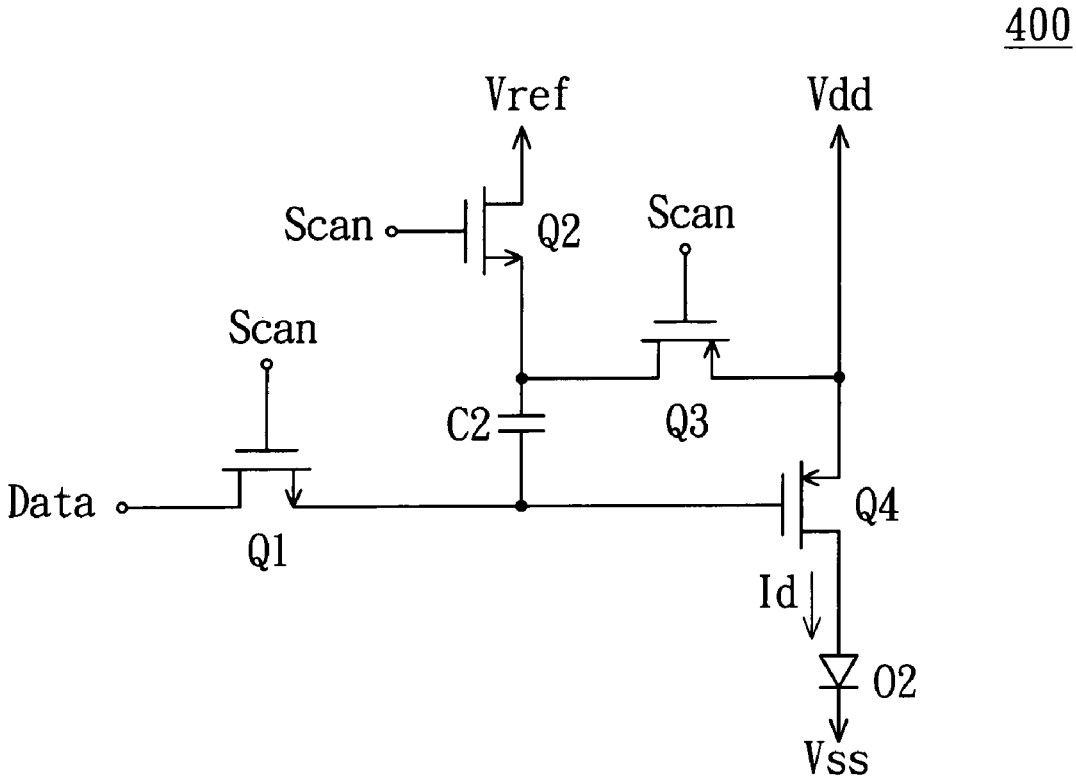
FIG. 4 is a circuit diagram showing an organic light emitting display unit according to a preferred embodiment of the invention.

FIG. 4 is a circuit diagram showing an organic light emitting display unit according to a preferred embodiment of the invention. Referring to FIG. 4, the organic light emitting display unit 400 includes a PMOS transistor Q4, an OLED O2, a capacitor C2, a first switch Q1, a second switch O2 and a third switch Q3. The PMOS transistor Q4 generates a driving current Id and has a source coupled to the third switch Q3 and a drain coupled to a positive end of the OLED O2. The OLED O2 emits light according to the driving current Id and has a negative end coupled to a low main voltage Vss. The capacitor C2 has a first end coupled to the first switch Q1 and a gate of the PMOS transistor Q4, and a second end coupled to the second switch Q2. The third switch Q3 is coupled between the capacitor C2 and the PMOS transistor Q4. For example, the third switch Q3 connects the second end of the capacitor C2 to the source of the PMOS transistor Q4.

The first switch Q1 is controlled by a scan signal Scan and is a NMOS transistor in this embodiment. The NMOS transistor Q1 has a drain for receiving the data signal Data, a gate for receiving the scan signal Scan, and a source coupled to the first end of the capacitor C2. The second switch Q2 is controlled by the scan signal Scan and is a NMOS transistor in this embodiment. The NMOS transistor Q2 has a drain for receiving a reference voltage Vref, a gate for receiving the scan signal Scan, and a source coupled to the second end of the capacitor C2. The third switch Q3 is controlled by the scan signal Scan, and is a PMOS transistor in this embodiment. The PMOS transistor Q3 has a drain coupled to the second end of the capacitor C2, a gate for receiving the scan signal Scan, and a source coupled to the source of the PMOS transistor Q4.

When the scan signal Scan is enabled, the first switch Q1 and the second switch Q2 is turned on, the third switch Q3 is turned off, the data signal Data is transmitted to the first end of the capacitor C2 via the first switch Q1, and the reference voltage Vref is inputted to the second end of the capacitor C2 via the second switch Q2. At this time, the crossover voltage Vc of the capacitor C2 is a difference Va between the reference voltage Vref and the data signal Data. At this time, the reference voltage Vref only functions to charge the capacitor C2, and no current will flow to the capacitor C2 after the charging operation is completed. Consequently, the reference voltage Vref does not encounter the problem of voltage drop and may be held at a constant level. When the scan signal Scan is disabled, the first switch Q1 and the second switch Q2 are turned off and the third switch Q3 is turned on such that the capacitor C2 is electrically connected to the PMOS transistor Q4. The source of the PMOS transistor Q4 is biased at the main voltage Vdd and a voltage difference Vgs between the source and the gate of the PMOS transistor Q4 substantially equals the crossover voltage Vc (i.e., difference Va) of the capacitor C2. The PMOS transistor Q4 generates the driving current Id corresponding to the difference Va.

Figure 5:
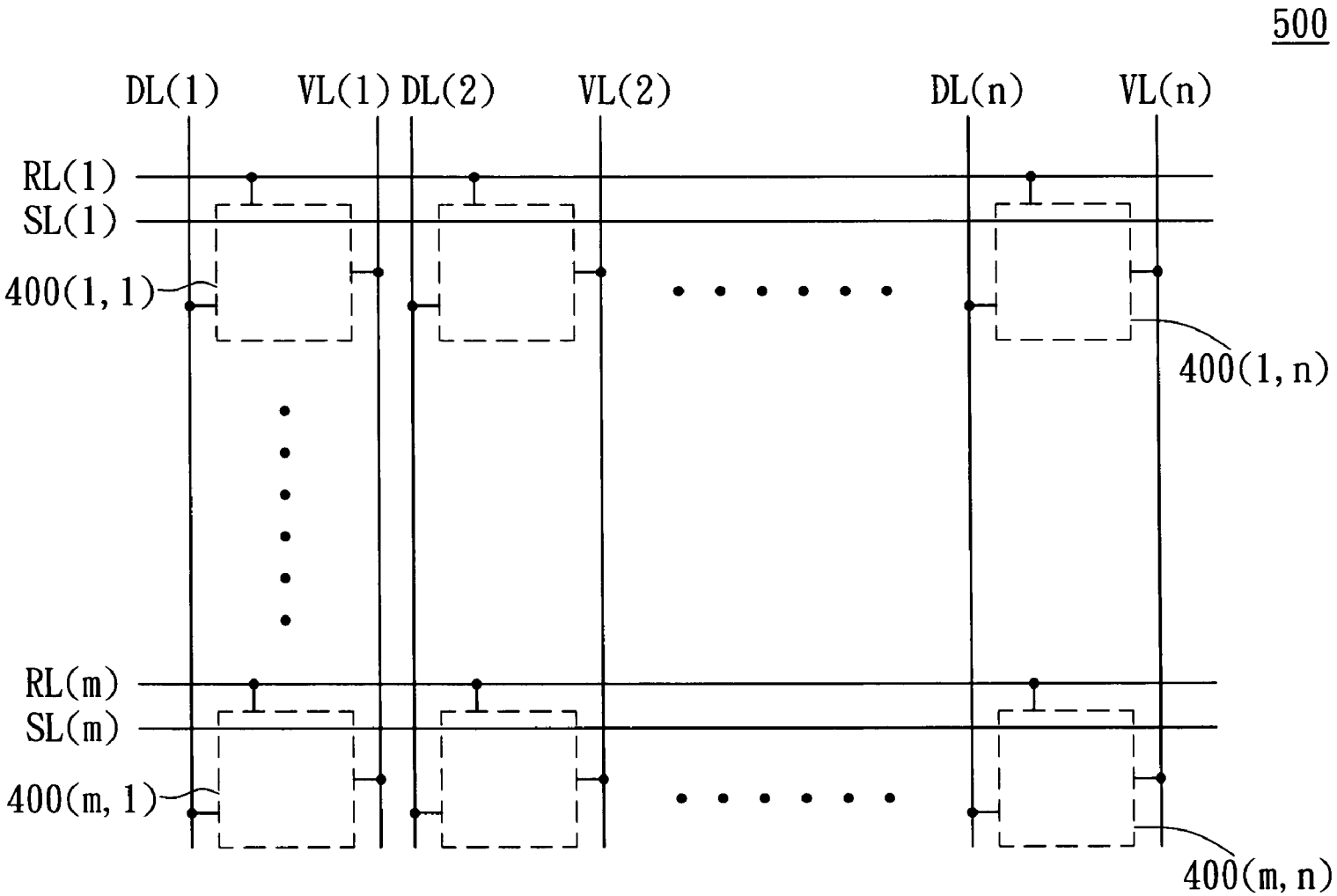
FIG. 5 is a schematic illustration showing an organic light emitting display according to a preferred embodiment of the invention.

FIG. 5 is a schematic illustration showing an organic light emitting display according to a preferred embodiment of the invention. Referring to FIG. 5, the organic light emitting display 500 includes display units 400(1,1) to 400(*m*,*n*), scan lines SL(1) to SL(m), data lines DL(1) to DL(n), main voltage lines VL(1) to VL(n), and reference lines RL(1) to RL(m). The scan lines SL(1) to SL(m) are for respectively transmitting scan signals Scan(1) to Scan(m) to the corresponding display units 400. The data lines DL(1) to DL(n) are for transmitting data signals Data(1) to Data(n) to the display units 400. The reference lines RL(1) to RL(m) are for outputting the reference voltage Vref to the display units 400. The main voltage lines VL(1) to VL(n) are for outputting the main voltage Vdd to the display units 400.

In this embodiments, when the first switch Q1 of the display unit 400 is embodied by the NMOS transistor, its drain is coupled to the data line DL in order to receive the data signal Data, its gate is coupled to the scan line SL in order to receive the scan signal Scan, and its source is coupled to the first end of the capacitor C2. When the second switch Q2 of the display unit 400 is embodied by the NMOS transistor, its drain is coupled to the reference line RL in order to receive the reference voltage Vref, its gate is coupled to the scan line SL in order to receive the scan signal Scan, and its source is coupled to the second end of the capacitor C2. When the third switch Q3 of the display unit 400 is embodied by the PMOS transistor, its gate is coupled to the scan line SL in order to receive the scan signal Scan, its source is coupled to the main voltage line VL in order to receive the main voltage Vdd, and its drain is coupled to the second end of the capacitor C2.

In the organic light emitting display and display unit thereof according to the embodiments of the invention, the luminance generated by the OLED is free from been influenced even if the main voltage has the voltage drop phenomenon because the luminance of the display unit is determined by the difference between the reference voltage and the data signal and the level of the reference voltage is constant. Therefore, the actual luminance and the expected luminance are substantially the same and are not influenced due to the loading effect and the actual luminance is uniform. If different main voltages are provided, the different product requirements may be directly met without adding extra circuit configurations. So, the invention further has the advantage of decreasing the cost.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An organic light emitting display unit, comprising:

a capacitor having a first end and a second end, the first end and the second end selectively and respectively receives a data signal and a reference voltage according to a scan signal;

a first P-type metal oxide semiconductor (PMOS) transistor having a gate coupled to the first end of the capacitor; and an organic light emitting diode (OLED) coupled to the first PMOS transistor;

wherein when the scan signal is enabled, the first end and the second end of the capacitor respectively receive the data signal and the reference voltage, and when the scan signal is disabled, a source of the first PMOS transistor is biased at a main voltage and coupled to the second end of the capacitor such that a voltage difference between the source and the gate of the first PMOS transistor substantially equals a crossover voltage of the capacitor, and the first PMOS transistor outputs a driving current, which corresponds to a difference between the data signal and the reference voltage, to the OLED.

2. The unit according to claim 1, further comprising:

a first switch, which is controlled by the scan signal, coupled to the first end of the capacitor, and for selectively transmitting the data signal;

a second switch, which is controlled by the scan signal, coupled to the second end of the capacitor, and for selectively outputting the reference voltage; and a third switch, which is controlled by the scan signal, coupled to the source of the first PMOS transistor, and for selectively outputting the main voltage;

whereby when the scan signal is enabled, the first switch and the second switch are turned on, the third switch is turned off, the first switch transmits the data signal, and the second switch outputs the reference voltage, and when the scan signal is disabled, the first switch and the second switch are turned off, and the third switch is turned on and outputs the main voltage.

3. The unit according to claim 2, wherein the first switch comprises an N-type metal oxide semiconductor (NMOS) transistor having a drain for receiving the data signal, a gate for receiving the scan signal, and a source coupled to the first end of the capacitor.

4. The unit according to claim 2, wherein the second switch comprises an NMOS transistor having a drain for receiving the reference voltage, a gate for receiving the scan signal, and a source coupled to the second end of the capacitor.

5. The unit according to claim 2, wherein the third switch comprises a second PMOS transistor having a drain coupled to the second end of the capacitor, a gate for receiving the scan signal, and a source coupled to the source of the first PMOS transistor.

6. The unit according to claim 2, wherein the third switch electrically connects the second end of the capacitor to the source of the first PMOS transistor.

7. An organic light emitting display unit, comprising:

a first switch controlled by a scan signal;

a second switch controlled by the scan signal;

a third switch controlled by the scan signal;

a first P-type metal oxide semiconductor (PMOS) transistor for generating a driving current, wherein the first PMOS transistor has a source coupled to the third switch;

an organic light emitting diode (OLED) for emitting light according to the driving current; and a capacitor having a first end coupled to the first switch, and a second end coupled to the second switch, wherein the third switch is coupled between the capacitor and the first PMOS transistor;

whereby when the scan signal is enabled, the first switch and the second switch are turned on, the third switch is turned off, a data signal is inputted to the first end of the capacitor via the first switch, a reference voltage is inputted to the second end of the capacitor through the second switch, and a crossover voltage of the capacitor at this time is a difference between the reference voltage and the data signal, and when the scan signal is disabled, the first switch and the second switch are turned off and the third switch is turned on such that the capacitor is electrically connected to the first PMOS transistor, the source of the first PMOS transistor is biased at a main voltage and a voltage difference between the source and a gate of the first PMOS transistor substantially equals the crossover voltage of the capacitor, and the first PMOS transistor generates the driving current corresponding to the difference.

8. The unit according to claim 7, wherein the first switch comprises an N-type metal oxide semiconductor (NMOS) transistor having a drain for receiving the data signal, a gate for receiving the scan signal, and a source coupled to the first end of the capacitor.

9. The unit according to claim 7, wherein the second switch comprises an N-type metal oxide semiconductor (NMOS) transistor having a drain for receiving the reference voltage, a gate for receiving the scan signal, and a source coupled to the second end of the capacitor.

10. The unit according to claim 7, wherein the third switch comprises a second PMOS transistor having a drain coupled to the second end of the capacitor, a gate for receiving the scan signal, and a source coupled to the source of the first PMOS transistor.

11. The unit according to claim 7, wherein the third switch electrically connects the second end of the capacitor to the source of the first PMOS transistor.

12. An organic light emitting display, comprising:

a display unit, which comprises:

a first switch controlled by a scan signal;

a second switch controlled by the scan signal;

a third switch controlled by the scan signal;

a first P-type metal oxide semiconductor (PMOS) transistor, which has a source coupled to the third switch, for generating a driving current;

an organic light emitting diode (OLED) for emitting light according to the driving current; and a capacitor having a first end coupled to the first switch and a second end coupled to the second switch, wherein the third switch is coupled between the capacitor and the first PMOS transistor;

a scan line for transmitting the scan signal, wherein the scan line is coupled to the first switch, the second switch and the third switch;

a data line, coupled to the first switch, for transmitting a data signal; and a reference line, coupled to the second switch, for outputting a reference voltage; and a main voltage line, coupled to the third switch, for outputting a main voltage;

wherein when the scan signal is enabled, the first switch and the second switch are turned on, the third switch is turned off, the data signal is transmitted to the first end of the capacitor via the first switch, the reference voltage is inputted to the second end of the capacitor via the second switch, and a crossover voltage of the capacitor at this time is a difference between the reference voltage and the data signal, and when the scan signal is disabled, the first switch and the second switch are turned off and the third switch is turned on such that the capacitor is electrically connected to the first PMOS transistor, the source of the first PMOS transistor is biased at the main voltage, a voltage difference between the source and a gate of the first PMOS transistor substantially equals the crossover voltage of the capacitor, and the first PMOS transistor generates the driving current corresponding to the difference.

13. The display according to claim 12, wherein the first switch comprises an N-type metal oxide semiconductor (NMOS) transistor having a drain for receiving the data signal, a gate for receiving the scan signal, and a source coupled to the first end of the capacitor.

14. The display according to claim 12, wherein the second switch comprises an N-type metal oxide semiconductor (NMOS) transistor having a drain for receiving the reference voltage, a gate for receiving the scan signal, and a source coupled to the second end of the capacitor.

15. The display according to claim 12, wherein the third switch comprises a second PMOS transistor having a drain coupled to the first end of the capacitor, a gate coupled to the scan line, and a source coupled to the gate of the first PMOS transistor.

16. The display according to claim 12, wherein the third switch electrically connects the second end of the capacitor to the source of the first PMOS transistor.

* * * * *